United States Patent [19]

Matsuo et al.

[11] 3,990,614

[45] Nov. 9, 1976

[54] METHOD OF REGULATING THE FLOW OF MOLTEN METAL THROUGH THE POURING OPENING OF A VESSEL

[75] Inventors: Terumoto Matsuo; Kazumichi Honda; Tadao Uryu; Fusakazu Kotzumi, all of Kitakyushu; Yasunobu Ikehara; Takashi Yanai, both of Hikari, all of Japan

[73] Assignees: Kurosaki Yogyo Co., Ltd.; Mishima Kosan Co., Ltd., both of Fukuoka; Nippon Steel Corporation, Tokyo, all of Japan

[22] Filed: Dec. 23, 1975

[21] Appl. No.: 643,948

[30] Foreign Application Priority Data

Dec. 27, 1974 Japan ..... 49-50656

[52] U.S. Cl. ..... 222/504; 222/561

[51] Int. Cl.[2] ..... B22D 37/00

[58] Field of Search ..... 222/52, 63, 559, 561, 222/333, 504; 137/131, 132, 14

[56] References Cited

UNITED STATES PATENTS

| | | | |
|---|---|---|---|
| 3,866,806 | 2/1975 | Shapland, Jr. | 222/504 |
| 3,941,281 | 3/1976 | Hind | 222/63 |

*Primary Examiner*—Stanley H. Tollberg
*Attorney, Agent, or Firm*—Frank J. Jordan

[57] ABSTRACT

A method of regulating the flow of molten metal through the pour opening of a vessel is disclosed which is characterized by a combination of a pair of load detecting elements and a contactor which is disposed between the load detecting elements such that there is effected control of a hydraulic cylinder for actuating a sliding control nozzle which is capable of moving bit-by-bit resulting in the fine regulation of the sliding control nozzle.

16 Claims, 12 Drawing Figures

METHOD OF REGULATING THE FLOW OF MOLTEN METAL THROUGH THE POURING OPENING OF A VESSEL

BACKGROUND OF THE INVENTION

This invention relates to a method of regulating the flow of molten metal through the pouring opening of a vessel.

Conventionally, the performance of a device for regulating the flow of liquid such as a device for regulating the flow of molten metal through a pour opening of a vessel is not satisfactory particularly when a fine or delicate adjustment, e.g., from 1 to several mm, is required. This is especially true when a stopper, as shown in FIG. 5, is employed as the device for regulating the flow of molten metal through the pour opening of a vessel into a continuous casting machine to produce various kinds of slabs or the like.

This conventional regulating method has a serious fault; namely, fine regulation of the flow of molten metal through the pour opening of the vessel is impossible.

Furthermore, since the stopper head is always subjected to a force which tends to pull the head down into the pour opening, the head is often fractured.

In order to solve the above problem, a sliding nozzle which is shown in FIG. 6 has recently been developed and which is principally used as the device to regulate the flow of molten metal from a vessel. The sliding nozzle has achieved great success in preventing accidents which have arisen with the stopper means.

However, a problem still exists with the above regulating method. That is, this method which utilizes the sliding nozzle usually comprises two or three plates wherein one of them is moved in order to regulate the relative size of the opening of each plate; thereby the flow of the molten metal flowing through the pour opening is determined by the size of the opening or the amount that the plate has been slid. Usually a method to regulate the above sliding distance of the plate is conducted by regulating the amount of oil supplied to a hydraulic cylinder which causes the sliding movement of the plate. However fine regulation of the sliding length of the plate per single actuation of the cylinder is difficult to obtain.

Accordingly, even a skilled operator cannot regulate the sliding distance of the plate 1 mm to several mm but greatly exceeds the desired sliding distance which is necessary to produce small-sized slabs such as blooms of good quality. Even when the operator manages to successfully finely adjust the distance, he must conduct frequent open-and-close sliding operations to obtain stability of the surface of the molten metal in the mold which requires the operator's delicate and utmost care. Furthermore, the above frequent sliding operations cause rapid corrosion of the plates and thereby results in turbulence in the flow of molten metal through the pour opening of the vessel.

It is an object of the present invention to provide a method for finely regulating the flow of molten metal in such a way that the plate of the sliding nozzle is slid precisely bit-by-bit within a small stroke in a short period, while eliminating the disadvantages of the methods and apparatuses fo the prior art.

It is an object of the present invention to provide an apparatus for finely regulating the flow of molten metal through a pour opening of a vessel which is simple in construction and yet is capable of achieving the fine adjustment of the operation of the sliding nozzle.

It is a further object of the present invention to provide a method as well as an apparatus for finely adjusting the flow of molten metal glass through the pour opening of a vessel.

Due to the method and apparatus of this invention, the sliding distance of the plate of the sliding nozzle can be precisely regulated at the minimum to a length of 0.2mm so that the desired sliding distance necessary to produce blooms or slabs of good quality can be easily obtained. Furthermore, if this device is coupled with a device for detecting the level of molten metal in the mold, automatic pouring of the molten metal can be achieved.

DETAILED DESCRIPTION OF THE INVENTION

The apparatus and method of this invention substantially comprises a position-detecting base which is slidably mounted on a frame structure, a pair of load detecting elements which are mounted on the position-detecting base wherein the two elements face each with a narrow spaced (therebetween), and contactor which has one end disposed between the two load detecting elements and another end connected to the power driven rod of a actuating means for actuating a slidng nozzle. A regulating-signal generating circuit generates one regulating signal to exert or stop the actuation of the power driven means and another regulating signal to exert or stop the sliding movement of the position-detecting base.

Referring to the general principles of the mode of operation of the method, the contactor which has one end connected to the actuating rod of the power-driven means for sliding the plate of the sliding nozzle means into contact with one of the load detecting elements by the actuation of the power driven means which is caused by an order signal. After the above contact, the power driven means is still given the order signal to actuate on so as to press the contactor in the same direction. Due to the pressure load which it receives, the load-detecting element transfers the input signals to the regulating-signal generating circuit. Then the generating circuit in response to the input signal generates an output signal which causes the sliding movement of the position-detecting base relative to the frame structure until the other load detecting element comes into contact with the contactor which is then kept stationary. After that operation, another output signal is generated in the generating circuit and is given to the power driven means to cause the actuation thereof so as to move the contactor until it comes again into contact with the original load detecting element. If the actuation of the power driven means which moves the contactor in the opposite direction is required after the contactor comes into contact with the load-detecting element, the output signal is transferred from the generating circuit to the power driven means so as to move the contactor until it moves into contact with the load-detecting element. The sliding movement or the feed equal to the length of movement the contactor is repeated hereinafter whereby the power driven means is actuated bit-by-bit and the fine regulating of the flow of molten metal through the pour opening of a vessel is achieved.

Accordingly, if the above method is applied to the device for regulating the flow of the liquid, especially the device for regulating the flow of molten metal through the pouring opening of a vessel, the sliding length or feed length of the load-detecting element per one actuation which is equal to that of the plate of the sliding nozzle can be minimized to 0.2 mm.

Figure 1:
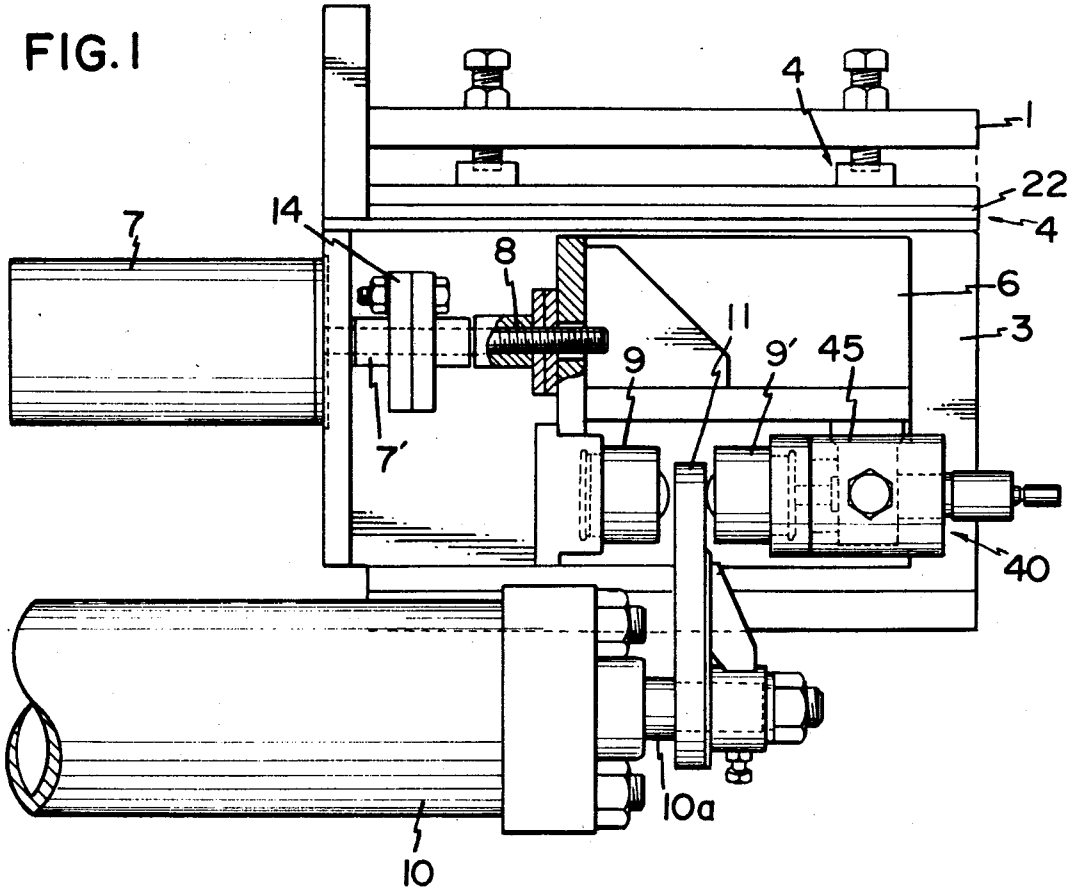
FIG. 1 is a front view partly broken away and in section of the fine adjusting apparatus which is used in the flow-regulating method of this invention.
Figure 2:
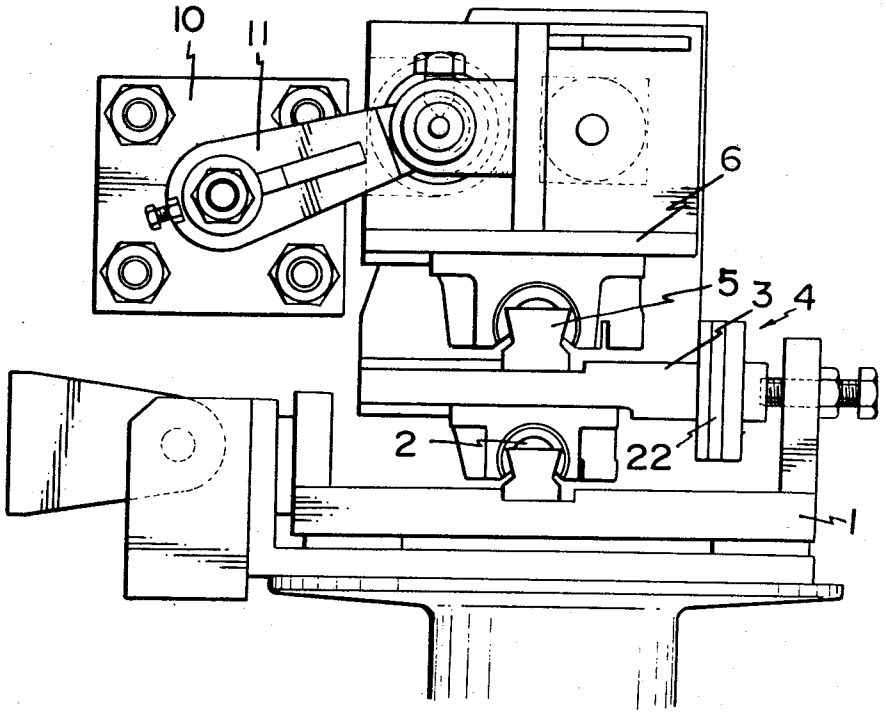
FIG. 2 is a side view of the apparatus in FIG. 1.

As shown in FIG. 1 and FIG. 2, a sliding base 3 is slidably mounted on a frame struction 1 by means of a linear slide bearing 2. A suitable crutching device 4 is disposed between the side wall of the sliding base 3 and the frame structure 1. A position-detecting base 6 is slidably mounted on the sliding base 3 by means of another linear slide bearing 5 wherein the sliding direction of the detecting base 6 is the same as that of the sliding base 3. A power-operated actuator 7 such as a power-operated responsyn motor is fixedly mounted on the rear end of the sliding base 3 wherein the driving shaft 7' of the actuator 7 is connected with a threaded shaft 8 by a coupling means 14. Threaded shaft 8 has another end threaded into a rear vertical wall on the position-detecting base 6. Furthermore a pair of load-detecting elements 9, 9' are mounted face to face on the position-detecting base 6 at a predetermined distance apart wherein one detecting element 9 is fixedly attached to a vertical rear wall of the position-detecting base 6 and another detecting element 9' is attached to a distance-adjusting mechanism 40 which is in turn connected to a lug 45 which is fixedly attached to a vertical rim of the detecting base 6. A contactor 11 has one end disposed between the load-detecting elements 9 and 9' and has another end connected to the distal end of one actuating rod 10*a* of a double-actuating hydraulic cylinder 10 which is disposed parallel and adjacent to the sliding base 3. The hydraulic cylinder has another actuating rod 10*b* which is connected to a plate 17*a* of a sliding nozzle 17 by which the flow of molten metal through the pouring opening of a vessel 16 is regulated. The load-detecting elements 9 and 9' are electrically interlocked with the power-operated motor 7 and the hydraulic cylinder 10 by means of a regulating-signal generating circuit 12 in such a way that the generating circuit 12 generates one output signal which exerts or stops the actuation of the hydraulic cylinder 10 and another signal which exerts or stops the actuation of the actuator 7 which rotation causes the sliding movement of the position detecting base 6.

The manner in which the device of this invention operates is hereinafter disclosed.

A. The sliding plate 17*a* of the sliding nozzle 17 is first required to be slid to a great degree for the purpose of opening or closing the pouring opening of a vessel at the first or last stage of operation respectively, wherein the clutching device 4 is loosened to alleviate the frictional force or magnetic force between the sliding base 3 and the clutching device 4. At this stage of the operation, the fine regulating apparatus including the regulating-signal generating circuit 12 which uses the method of this invention is not activated.

In FIG. 1 and FIG. 2, when the hydraulic cylinder 10 is actuated by an order signal from a power source, the contactor 11 comes into contact with either load-detecting element 9 or 9' and bears against the element. Since the frictional force between the sliding base 3 and the clutching device is alleviated, the sliding base 3 is also moved to a desired position in opposition to the frictional force, thus the actuating rod 10*b* is also moved in either direction so as to close or open the sliding nozzle 17 as a rough adjustment.

B. In conducting the subsequent fine adjustment, the clutching device 4 and the regulating-signal generating circuit 12 are both activated. When the contactor 11 comes into contact with right load-detecting element 9', a regulating output signal is generated by the generating circuit 12 after receiving an input signal from the element 9'. This output signal then causes the actuating rod 10*a* to move to the left. When the contactor 11 comes into contact with the left load-detecting element 9 after moving a minute distance (e.g., 0.4 mm), the load-detecting element 9 detects the load of the hydraulic cylinder 10 since the element 9 cannot move due to the friction of the friction plate 22 of the clutching device 4 which is disposed between the frame structure 1 and the sliding base 3. Accordingly a signal from the element 9 is transferred to the generating circuit 12 as an input signal so that the generating circuit generates an output signal which stops the movement of the hydraulic cylinder 10.

If an order signal which moves the sliding nozzle 17 to the left is given, the actuator 7 is driven so that the position-detecting base 6 is moved to the left due to the relationship between the threaded shaft 8 and the position-detecting base 6. Upon movement of the defecting base 6 to the left, the right load-detecting element 9' is moved into contact with the contactor 11.

Since the detecting element 9' cannot move due to the friction plate 22 of clutching device 4, the detecting element 9' detects the load of the actuator 7 and transfers an input signal to the generating circuit 12 which generates an output signal to stop the operation of the actuator 7 and another output signal to make the actuating rods 10*a*, 10*b* of the hydraulic cylinder 10 to move to the left until the contactor 11 comes into contact with left load-detecting element 9.

If an order signal which moves the sliding nozzle 17 to the right is given, the actuating rods 10*a*, 10*b* are moved to the right until the contactor 11 comes into contact with right load-detecting element 9'. When it contacts the element 9', it transfers the input signal to the regulating-signal generating circuit 12 which generates the regulating output signal to stop the actuation of the hydraulic cylinder 10.

In either right or left movement of actuating rods 10*a*, 10*b* of the hydraulic cylinder 10, the sliding nozzle 17 is moved and positioned to a desired precise position by the repetition of above bit by bit sliding movement.

In the drawings, numeral 18 is a mold, numeral 19 a hydraulic control device, numeral 20 a pinch roll, numeral 21 being an actuating transformer for detecting the overall sliding length of the actuating rod of the hydraulic cylinder 10, and numeral 22 a friction plate which is included in the clutching device 4. The hydraulic cylinder 10 can be replaced by a penumatic cylinder, an electric motor and so forth where it is desirable that the actuating speed of each device be capable of being switched to either high or low speed. Magnetic cells, limit switches, or non-contact switches may be used in place of load detecting elements 9 and 9′. The maximum load which causes the load detecting element 9 or 9′ to generate an input signal must be adjusted to be less than the frictional resistance of the friction plate 22.

Figure 3:
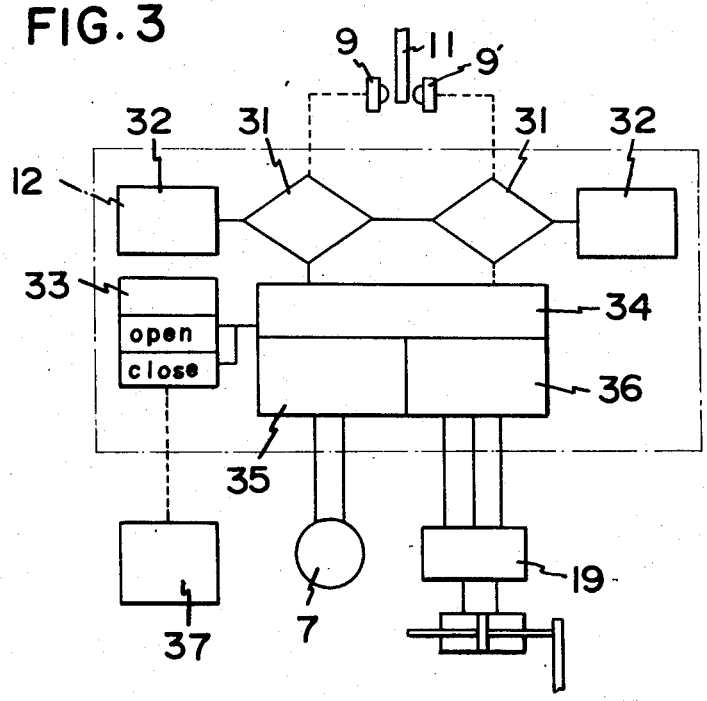
FIG. 3 is a block diagram of the regulating-signal generating circuit which is used in the method of this invention.
Figure 4:
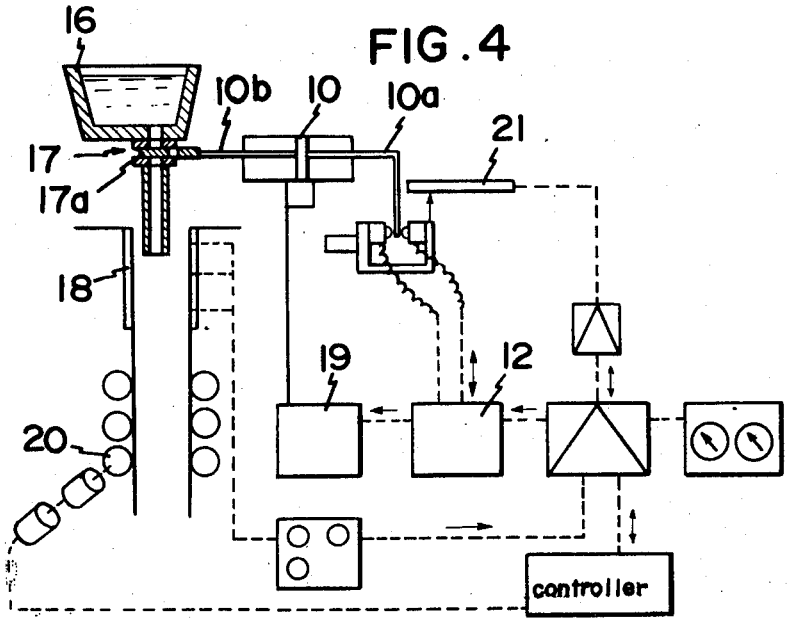
FIG. 4 is a schematic view showing the apparatus of this invention applied to the flow control of the molten metal through the pour opening of a vessel.

FIG. 3 shows a block diagram of the regulating-signal generating circuit 12 which is employed in the flow regulating method of this invention wherein 31 indicates a load-detecting block, 32 a load-setting block, 33 a direction block, 34 a regulating block which comprises a motor regulating block 35 and a hydraulic cylinder regulating block 36, and 37 a control panel. When the contactor 11 is not in contact with either load detecting element 9 or 9′, the motor 7 should be driven so that the position-detecting base 6 is moved until the contactor 11 comes into contact with either element 9 or 9′. In other words, it is desirable that the regulating-signal generating circuit 12 is arranged such that the contactor 11 is always in contact with either load-detecting element 9 or 9′. For restricting the movement of the sliding base 3, magnetic forces can be used in place of the frictional resistance of the friction plate 22. Furthermore in place of the threaded shaft 8, a screw bolt or an actuating cylinder can be used.

Figure 5:
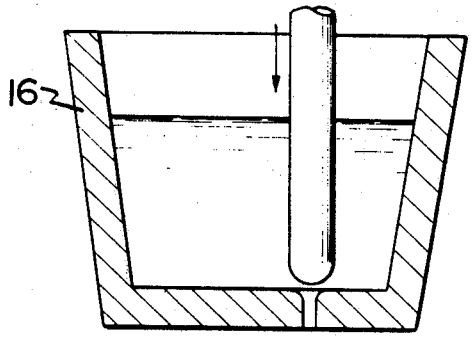
FIG. 5 is a schematic view of the conventional stopper type apparatus for opening or closing the pouring opening of a vessel.
Figure 6:
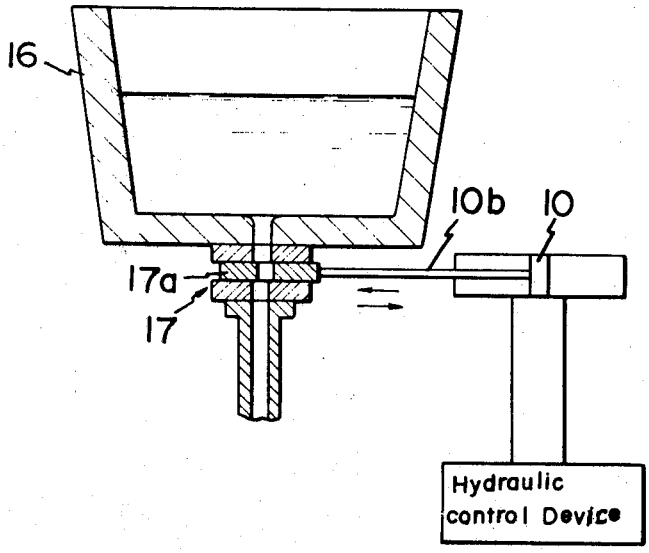
FIG. 6 is a schematic view of the sliding nozzle which is not equipped with the flow regulating circuit of this invention.
Figure 7:
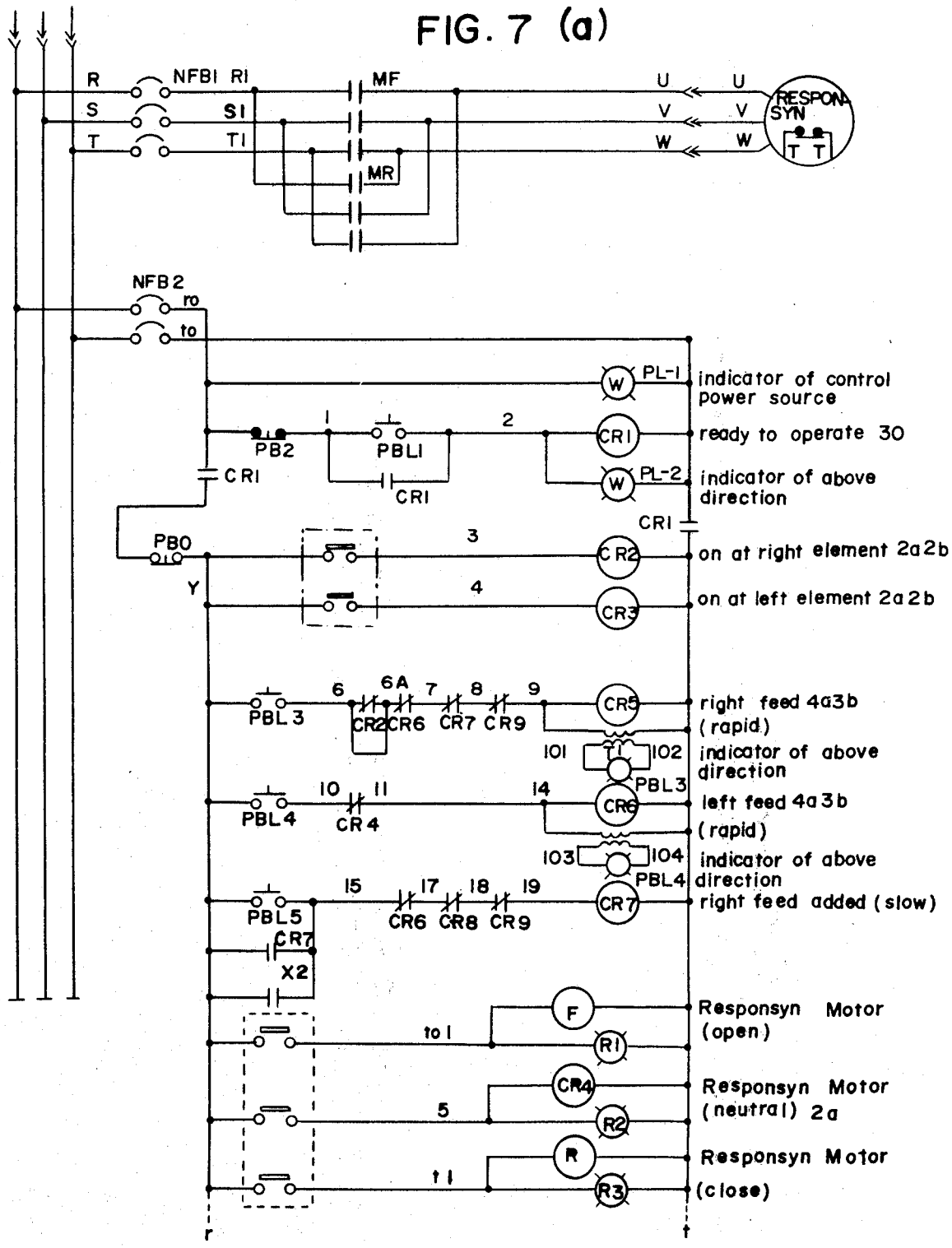
FIG. 7(*a*), FIG. 7(*b*), and FIG. 7(*c*) are electro-circuit diagrams used by the apparatus of FIG. 1.
Figure 7B:
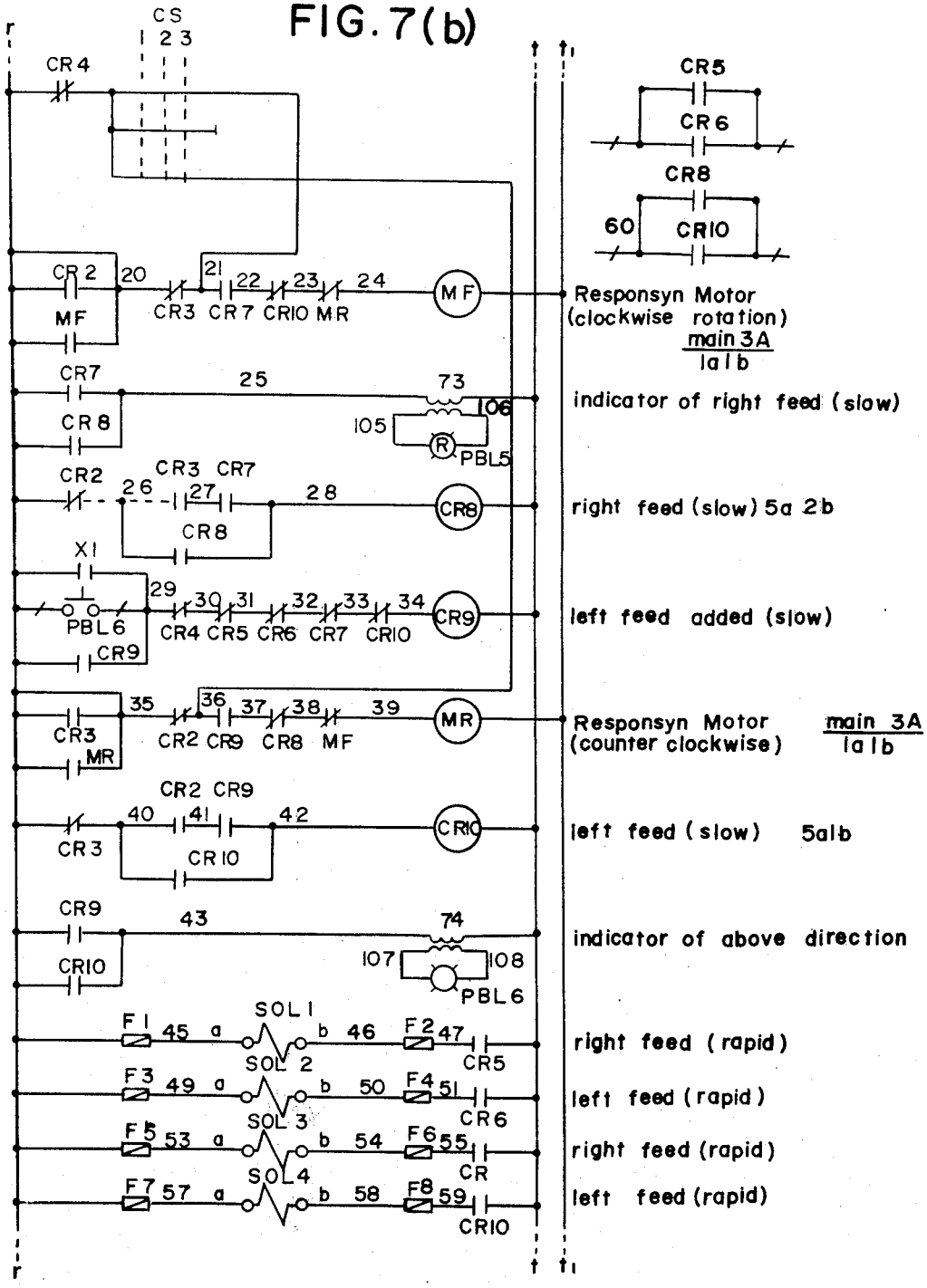
Figure 7:
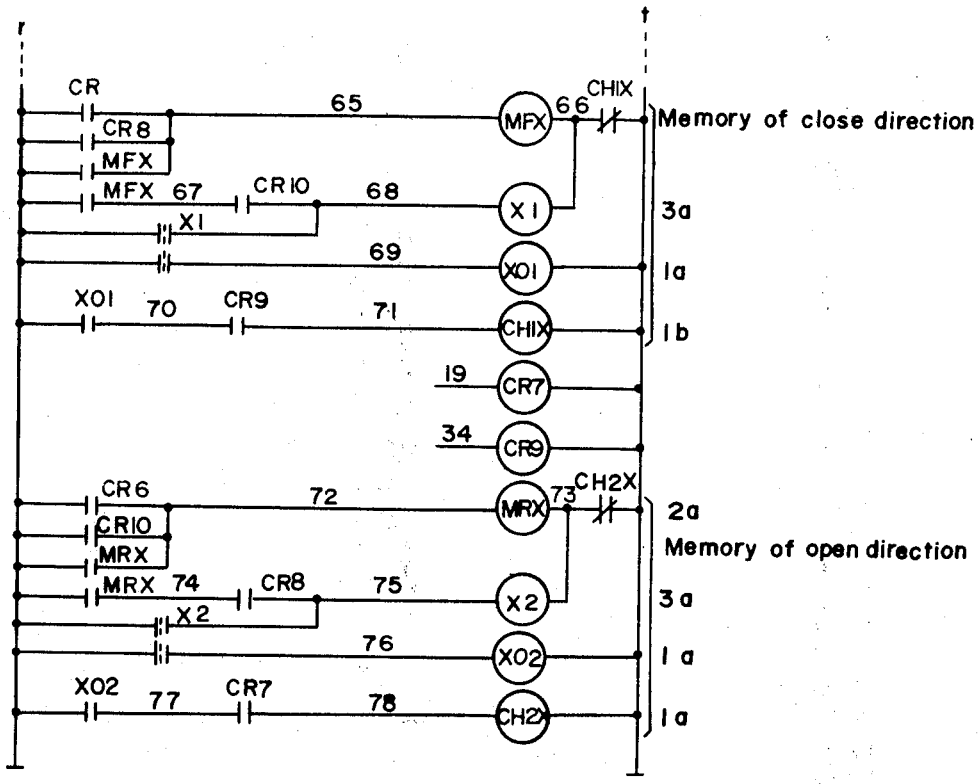

It is also possible that the position-detecting base 6 may be directly mounted on the frame structure 1 which may be fixedly mounted on the bottom of the vessel 16 without employing the clutching device 4 wherein the fine adjustment of the sliding nozzle is conducted in a way as described in the above explanation (B) while the operations described in the above explanation (A) which are required for rough opening or closing of the pouring opening of a vessel, or in the emergency, are conducted by a stopper means which is shown in FIG. 5.

Figure 9:
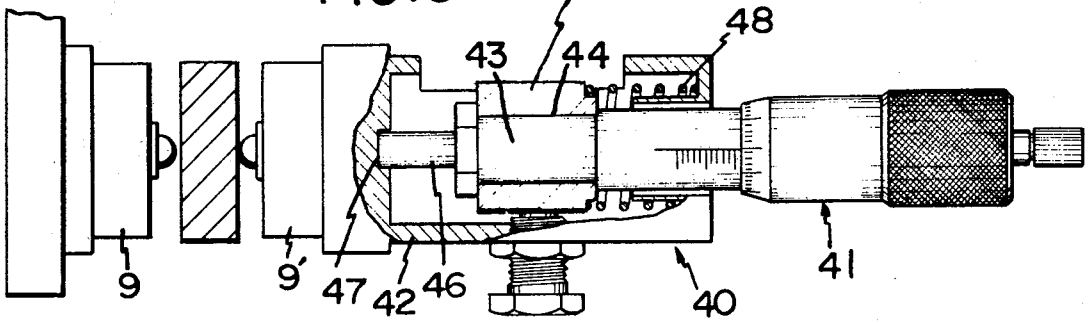
FIG. 9 is an enlarged view partly broken away and in section of the distance-adjusting mechanism of the device of FIG. 1.
Figure 10:
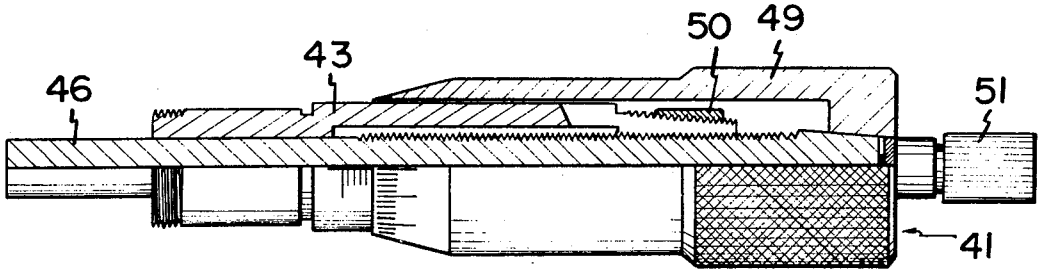
FIG. 10 is a longitudinal front view partly broken away and in section of a micrometer calliper used in above distance-adjusting mechanism.

Precise adjustment of the distance between the load-detecting elements 9 and 9′ can be achieved by the manupulation of the distance-adjusting device 40 which includes a micrometer calliper 41. As can be best understood from FIG. 9 and FIG. 10, numeral 42 indicates a hollow cylindrical body to which one load-detecting element 9′ is attached. Numeral 43 is a sleeve portion of the micrometer calliper 41 which is fixedly disposed in a horizontal hole 44 formed in the lug 45 (FIG. 1) which is in turn fixedly attached to the vertical rim of the position-detecting base 6. This micrometer calliper 41 is concentrically disposed within the hollow body 42 in such a way that a distal spindle portin 46 of the micrometer calliper 41 is always kept in contact with the recess 47 formed to in a central portion of one side-wall of the hollow body 42 by means of a compression spring 48 which is disposed over the sleeve portion 43 of the micrometer calliper 41 between the lug 45 and another side-wall of the cylindrical body 42. With respect to the construction of the micrometer calliper 41 in FIG. 10, numeral 49 indicates a thimble whose rotation causes the extension and retraction of the spindle 46 since the mating threads T are formed on the outer surface of the spindle 46 and the inner surface of the sleeve 43. Numeral 50 indicates a tapered nut and numeral 51 indicates a knob.

Referring to the operation of this distance-adjusting mechanism 40, when the thimble 49 is rotated, the spindle 46 can be slidably extended or retracted with a reading having an accuracy which is usually 0.01 mm.

The sliding length of the spindle 46 is directly read as the sliding length of the cylindrical body 42 since the cylindrical body 42 is always urged against the spindle 46 of micrometer calliper 41 by means of the compression spring 48. This implies that the distance between the load-detecting elements 9 and 9′ can be adjusted within an accuracy of 0.01 mm.

Figure 8:
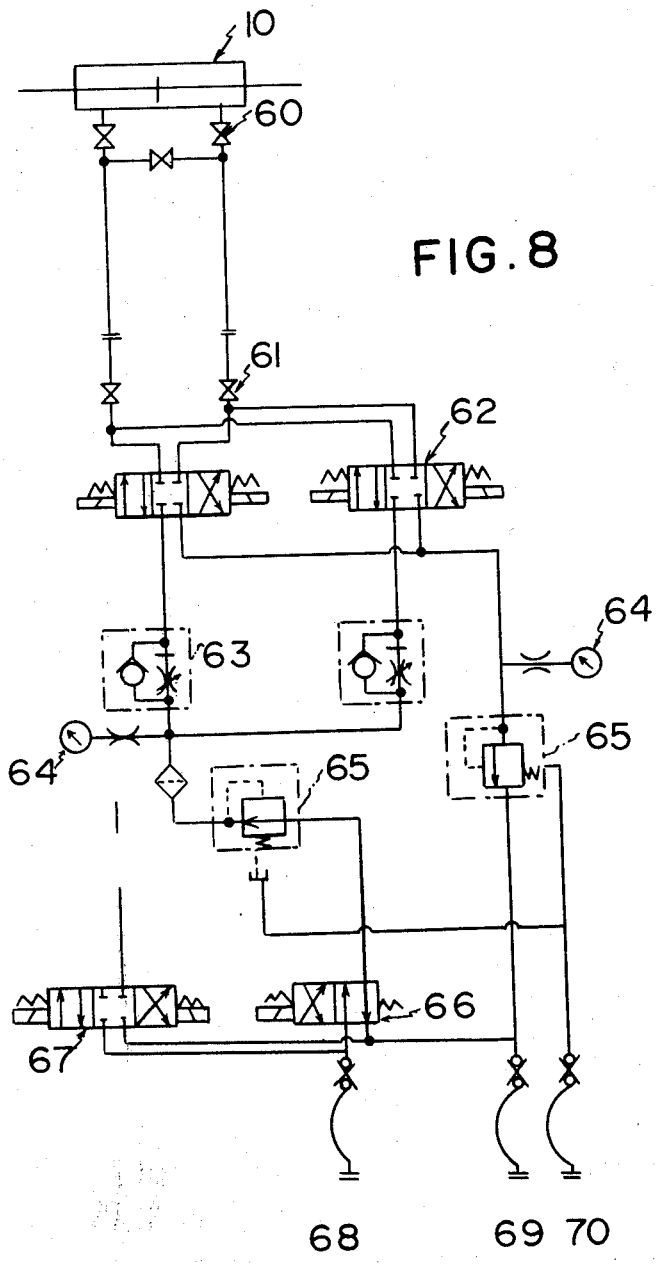
FIG. 8 is a hydraulic circuit diagram used by the apparatus of FIG. 1.

In FIG. 8, numeral 60 and 61 indicate stop valves, 62 solenoid operated valves, 63 flow control valves or speed controllers, 64 pressure gauges, 65 reducing valves and 66, 67 soolenoid operated valves. 68, 69 and 70 are hydraulic lines which lead to a hydraulic pump, a tank and a drain respectively.

According to the method of this invention which is applied to the control of the flow of molten metal through the pouring opening of a vessel by the sliding nozzle, the sliding movement of the plate of the sliding nozzle 17 can be precisely regulated in such a way that the sliding distance of the above plate per one actuation of a cylinder can be adjusted to 0.2 mm at its minimum and the number of sliding operations to locate the plate to a desired position can be drastically decreased so that fracture or corrosion of the sliding nozzle is prevented as much as possible and the flow of the pouring molten metal is not distributed, whereby steel products ranging from slabs to blooms of precise size and of good quality can be produced and the automatic pouring of molten metal into the continuous casting machine can be achieved, being coupled with a suitable device for detecting the surface of the molded molten metal.

What we claim is:

1. A method for regulating the flow of molten material through the pour opening of a vessel by controlling the position of a sliding nozzle element, comprising slidably mounting a position-detecting means on a base element, slidably mounting a power driven means for controlling the position of said sliding nozzle element, interrelating said power driven means with said position-detecting means by disposing a contactor on said power driven means between two spaced load detecting elements on said position-detecting means, operating said power driven means to move said sliding nozzle means, stopping operation of said power driven means when said contactor on said power driven means comes into contact with one of said load detecting elements on said position-detecting means, sliding said position-detecting means until said other load detecting element on said position-detecting means comes into contact with said contactor on said power driven means, once again operating said power driven means to move said sliding nozzle element after said other load detecting element has contacted said contactor, and repeating the above operational steps sequentially whereby the sliding nozzle is thereby finely and incrementally controlled.

2. A method according to claim 1 comprising effecting sliding movement of said position-detecting means by utilizing an actuator means, effecting operation of said actuator means to slide said position-detecting means when said contactor on said power driven means comes into contact with said one of said load detecting elements, and stopping operation of said actuator means when said other load detecting element on said position-detecting means comes into contact with said contactor on said power driven means.

3. A method according to claim 2 wherein said steps of stopping operation of said actuator means and effecting operation of said power driven means are effected substantially simultaneously when said other load detecting element on said position-detecting means comes into contact with said contactor.

4. A method according to claim 2 wherein said steps of stopping operation of said power driven means and starting operation of said actuator means is effected substantially simultaneously when said contactor on said power driven means comes into contact with said one load detecting element.

5. A method according to claim 1 wherein said position-detecting means is slidable in a linear direction, said contactor being movable in the same linear direction when said power driven means is operated.

6. A method according to claim 1 comprising controlling the operation of said power driven means by adjusting the spacing between said two load detecting elements.

7. A method according to claim 1 comprising operating said power driven means to effect linear movement of a fluid operated piston operably connected to said sliding nozzle element and to said contactor.

8. Apparatus for regulating the flow of molten material through the pour opening of a vessel by controlling the position of a sliding nozzle element, comprising a base element adapted to be movably mounted on a frame structure, a position-detecting means slidably mounted on said base element for linear movement, an actuator means mounted on said base element and operable to slide said position-detecting means on said base element, a pair of spaced load detecting elements mounted on said position-detecting means, power driven means operable to control the position of said sliding nozzle element, and a contactor operated by said power driven means, said contactor being disposed within the space between said pair of load detecting elements, whereby said contactor is movable by said power driven means to cause said contactor to engage one of said load detecting elements to thereby control the operation of said power driven means and said actuator means, and said other load detecting element is movable with said position-detecting means to engage said contactor to thereby control the operation of said actuator means and said power driven means such that the position of said sliding nozzle element is thereby finely and incrementally controlled.

9. Apparatus according to claim 8 wherein said frame structure is mounted on the bottom of said vessel, and further comprising clutch means operably disposed between said frame structure and said base element, said clutch means being operable between an engaged and a released position, said clutch means providing for rough adjustment of said base element along said frame structure by said power driven means when said clutch is released and providing for fine and incrementally controlled adjustment of said sliding nozzle element when said clutch is engaged.

10. Apparatus according to claim 8 wherein said power driven means comprises a fluid operated cylinder-piston device having a longitudinal axis which is parallel to the direction of linear movement of said position-detecting means.

11. Apparatus according to claim 8 wherein one of said load detecting elements is fixedly mounted on said position-detecting means, and the other load detecting element is adjustably mounted on said position-detecting means to thereby provide for adjusting the space between said pair of load detecting elements.

12. Apparatus according to claim 11 further comprising micrometer means for adjusting the position of said other load detecting device on said position-detecting means.

13. Apparatus according to claim 8 wherein said actuator means comprises a motor, a threaded shaft driven by said motor, said shaft threadedly engaging said position-detecting means such that operation of said motor rotates said shaft to thereby slide said position-detecting means on said base element.

14. Apparatus according to claim 8 wherein said power driven means comprises a double acting piston operable in a cylinder, said double acting piston driving a piston rod extending from both sides of said piston, one of said piston rods being operably connected to said sliding nozzle element and the other of said piston rods being operably connected to said contactor.

15. Apparatus according to claim 8 wherein said control of the operation of said power driven means and said actuator means by engagement of said contactor with said one load detecting element includes activation of said power driven means to operate the latter to slide the sliding nozzle element and deactivating of said actuator means to stop sliding movement of said position-detecting means.

16. Apparatus according to claim 8 wherein said control of the opration of said actuator means and said power driven means by engagement of said other load detecting element with said contactor includes activation of said actuator means to slide said position-detecting means and deactivation of said power driven means to stop the latter and thereby stop the movement of said sliding nozzle element.

* * * * *